United States Patent [19]

Goodwin

[11] Patent Number: 4,571,980

[45] Date of Patent: Feb. 25, 1986

[54] DUCT-SHAPING MACHINE AND METHOD

[76] Inventor: Ray R. Goodwin, P.O. Box 3607, Omaha, Nebr. 68103

[21] Appl. No.: 436,840

[22] Filed: Oct. 21, 1983

Related U.S. Application Data

[63] Continuation-in-part of Ser. No. 198,607, Oct. 29, 1980, abandoned.

[51] Int. Cl.[4] ..... B21D 51/14

[52] U.S. Cl. ..... 72/381; 72/392; 72/403

[58] Field of Search ..... 72/370, 380, 381, 383, 72/384, 392, 393, 399, 401, 403

[56] References Cited

U.S. PATENT DOCUMENTS 2,483,001 9/1949 Carswell et al. .
2,916,076 12/1959 Young .
3,266,285 8/1966 Jensen .
3,312,099 4/1967 Koepf et al. .
3,403,543 10/1968 Gregory et al. .
3,561,248 2/1971 Bessho .
3,581,548 6/1971 Lilygren .
3,710,609 1/1973 Jones .
3,996,783 12/1976 Meserole .
4,027,522 6/1977 Clavin .

*Primary Examiner*—Lowell A. Larson
*Attorney, Agent, or Firm*—Hiram A. Sturges

[57] ABSTRACT

A duct-shaping machine having a pair of major-axis duct-shaping modules for elongating the cross section of a cylindrical duct as they are forced apart, a minor-axis compaction assembly having first and second compactors pressing inwardly towards the center line between the modules to flatten the sides of the duct.

22 Claims, 11 Drawing Figures

DUCT-SHAPING MACHINE AND METHOD

This application is a continuation-in-part of U.S. application Ser. No. 198,607, filed Oct. 29, 1980, entitled Duct-Shaping Machine and Method (now abandoned).

BACKGROUND OF THE INVENTION

Flat-oval duct-forming machines of the prior art have had minor-axis compaction surfaces which have been flat, requiring heavy, expensive steel construction to provide strength against the bending of the compaction surfaces out of shape. The heavy weight requirement has kept high the steel cost for such machines and also has increased the shipping costs. But the major problem with flat-surfaced minor-axis compactors has been the danger of duct leakage in the finished duct. This is because such ducts are made from cylindrical stock having circumferential spiraling strips of metal which are interlocked at their edges. Such interlocked seams are normally capable of withstanding leakage. However, when such ducts are shaped by a flat-oval duct-shaping machine of the flat minor-axis compacting surface type, then a great stress is placed on the duct seams which causes deformation at the seams and leakage danger.

It is, therefore, an objective hereof to provide a duct-forming machine having compacting surfaces which are curved because I have found that this does not deform the seams as greatly as flat-surfaced compactors, whereby duct leakage is eliminated.

Another objective of this invention is to reduce the cost and the weight of flat-oval duct-forming machine minor-axis compactors by providing light, hollow, braced minor-axis compactors each having a convex compaction surface held in place by a flat backside steel sheet fixed thereto.

Other objectives are to provide for adjustment to fit different sizes of ducts.

Yet another objective is to provide a way to place a heavy cylindrical duct work-piece onto the machine by raising an upper major-axis pressing module at one end by the use of a pipe attached to a same fork-lift truck that delivers the heavy cylindrical work-piece to the shaping machine.

Still another objective is to provide for the placement of a duct work-piece onto the machine by having the upper major axis pressing module pivotally mounted on the frame adjacent one end thereof and having means for providing a rotational course on the upper module so as to cause it to swing upwardly at its other end onto which the cylindrical duct work-piece is then loaded. This force can be applied by a hydraulic cylinder assembly or by many other automatic means, such as, for example, a gear operated motor, so that at the push of a button, the operator can cause the duct receiving end of the upper pressing module to raise up to receive a duct, and at another pressing of a button can lower again into duct-shaping position.

Further objectives are to provide a pulley-hoist system for quick and minute vertical adjustments of the minor-axis compaction assembly with respect to upper and lower pressing modules, and the compactors each having a pivotal connection with the remainder of the compactor assembly along horizontal lines for automatic positioning by engagement of their convex surfaces with the duct.

Other objectives are for the modules each to be composed of a beam on which covers can be replaceably disposed by sliding them out and off of the beam swiftly without any bolts or attachments, the covers being stabilized by their weight and by gravity in cooperation with retainers and positioners attached to the covers and engageable with the beam.

Yet a further objective is to provide for an upper one of the modules to be supported between its ends on posts by a vertically adjustable keeper so that a new duct can be placed on the upper module while it is supported only by the keeper and by an hydraulic assembly at the opposite end of the upper module from its loading end so as to make use of a forklift truck unnecessary for upper module support during loading.

Another objective is for each beam to have a plurality of vertical webs connected to horizontal flanges for stiffness and strength under great pressure.

DESCRIPTION OF THE PREFERRED EMBODIMENT

Figure 1:
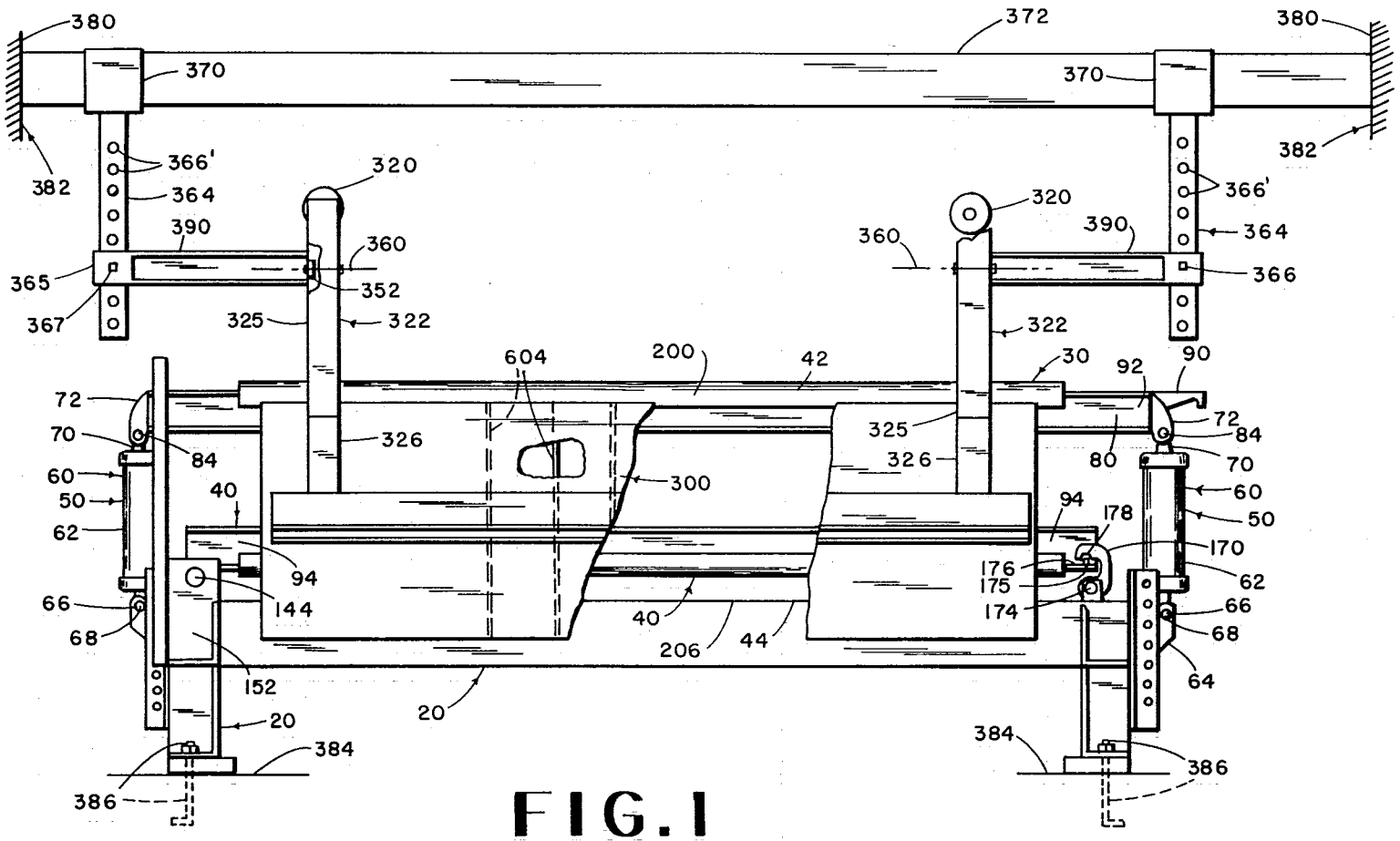
FIG. 1 is a frontal elevation of the duct-shaping machine of this invention, shown with a portion of a compactor broken away and a portion of the outer side enclosing covering of a compactor broken away for showing ribs thereunder.

In FIG. 1 the duct-shaping machine of this invention is shown at 10 and comprises a frame generally indicated at 20 on which are mounted first and second major axis duct-shaping modules 30 and 40. The first module 30 is disposed above the second module 40.

Figure 7:
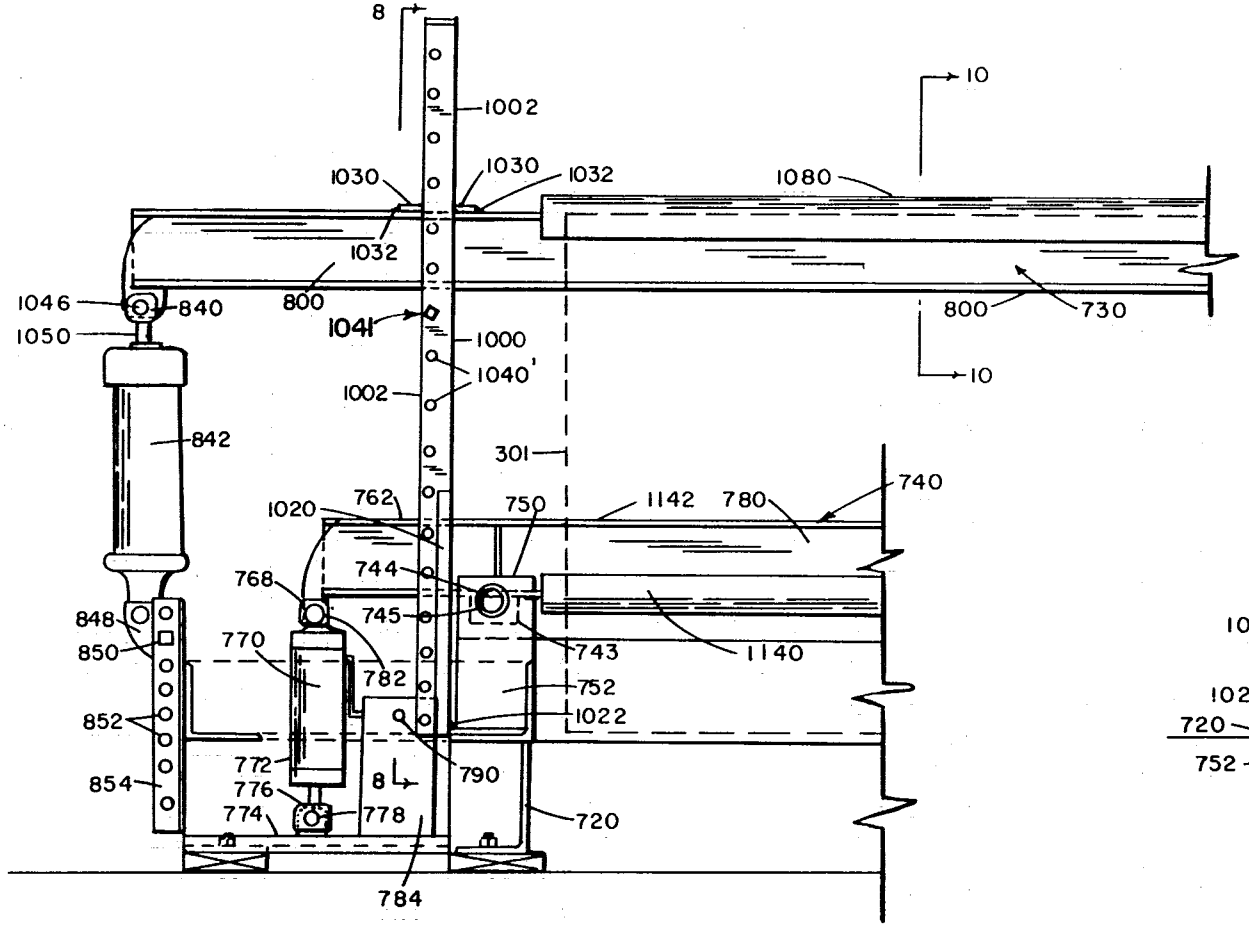
FIG. 7 is a view of a modification of the machine of this invention with its left end portion only being shown and with all minor axis compactors and compactor forcing assembly not being shown.

The modified machine 700 of FIG. 7 has two major-axis duct-shaping modules, namely, a first, or upper module 730 and a second, or lower module 740.

Each of the modules has a duct-pressing major surface 42 and 44 respectively. The first major surface 42 of the first module 30 is convex and faces upwardly. The second major surface 44 of the second module is also convex and faces downwardly.

The major surfaces 42 and 44 are spaced apart at all times and face in opposite directions.

In accordance with this invention, a major axis forcing and guiding assembly generally indicated at 50 is mounted on the frame 20 and will be later described and is connected to the modules 30 and 40 for forcing the modules to move apart linearly and vertically so as to cause the major surfaces 42 and 44 to move apart with respect to each other along a major axis generally indicated at 60 in FIGS. 3 and 4 and major axis forcing means 50 is shown having as its chief component a pair of hydraulic cylinder assemblies 60 having cylinders 62 disposed one at each end of the modules 30 and 40.

The lower ends of the cylinders 62 are hingedly mounted on the frame 20 by ears 64 and by pivot pins 66 so as to pivot only about horizontal pivot lines 68.

The rods 70 of each hydraulic cylinder assembly 60 are hinged by a hinge assembly 72 to an I-beam 80 of the first or upper axis duct-shaping module 30 for pivoting about a horizontal pivot line 84 at the upper end of each rod 70 and at the respective ends of the first and upper major module 30.

In FIG. 1 it can be seen that the upper first module 30 has a projection 90 attached to and projecting from an end 92 of the I-beam 80. The end 92 can be called the loading end or first end 92 of the I-beam 80 and the module 30.

Figure 2:
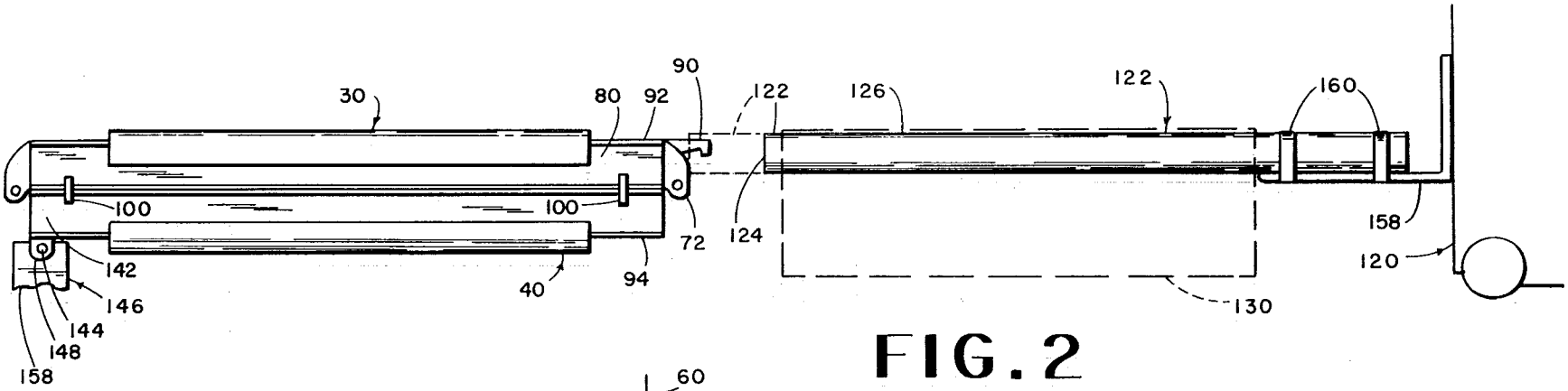
FIG. 2 is a frontal elevation of major-axis duct-shaping modules of the machine with the remainder of the machine removed and showing a forward end portion of a forklift truck with a pipe strapped thereto, the pipe having a cylindrical piece of duct work thereon, as shown in dotted lines. A position of the forward end of the pipe for lifting a duct-shaping module is also shown in dotted lines. The first and second duct-shaping modules, shown in FIG. 2, are temporarily fixed together by clips as the modules are raised at one end to place a duct work-piece thereon.

Referring now to FIG. 2, the method of loading round duct work onto the machine is illustrated. First of all, it is to be noticed in FIG. 2 that the loading end hydraulic cylinder assembly 60 is disconnected from the hinge 72 so that the upper I-beam 80 can rest down against the top of the I-beam 94 of the lower or second module 40. Next, C-shaped clips 100 are placed around the adjacent fingers of the I-beams 80 and 94 at both sides of both ends to assure that whenever the upper I-beam 80 is raised, the lower I-beam 94 will raise with it.

In order to raise the loading end 92 of the upper I-beam 80, a forklift truck 120 is brought up to the machine and the truck 120 has on it a pipe 122, which can also be called a module-lifting member 122, and the pipe 122 has a hollow forward end 124 which is received on the projection 90 so that at times when the forward end 126 of the lifting member 122 is raised, then the projection 90 will be raised with it lifting the loading end 92 of the upper module 30, and thereby raising with it the same adjacent end of the lower module 40.

It is not necessary that both ends of the modules 30 and 40 be raised in order to place a cylindrical duct work-piece 130 on the modules 30 and 40, and so the non-loading end 142 of the lower I-beam 94 of the lower or second module 40 is simply hinged to the frame by a pin 144 of a hinge assembly 146, which latter is partly composed of members 148 fixed to the lower I-beam 194 and hinge portion 152 fixed to the frame 20 beneath the lower I-beam 194, as seen in FIG. 1.

Because of the hinging at the pin 144, the raising of the loading end 92 of the upper I-beam 80 will raise only the same end of the lower I-beam 94, which is sufficient to allow a cylindrical duct work work-piece, seen in dotted lines in FIG. 2, to be moved by manual sliding over onto the modules 30 and 40.

The forklift truck can be of any suitable construction, but is preferably one that can be maneuvered about a factory area under its own power and steered, and one that is provided with a fork 158, seen in FIG. 2, to which the lifting member or pipe 122 is suitably connected in any manner, such as by connectors 160, shown in FIG. 2.

Therefore, the power of raising of the fork 158 by the operator of the forklift 120 will raise the pipe 122 so that the cylindrical duct work-piece 130 thereon can be slid over onto the modules 30 and 40 without interference from the frame of the duct-shaping machine 10.

Figure 3:
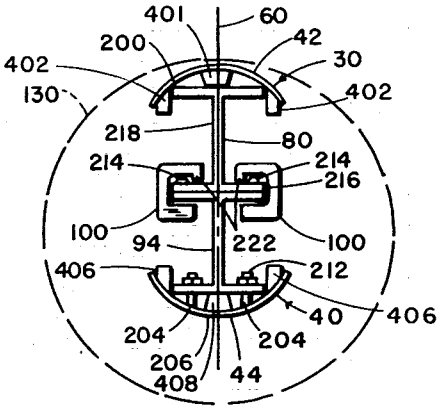
FIG. 3 is a detail showing the major axis pressing modules as seen from an end while they are clipped together during duct implacement, a cylinder duct work-piece being shown in dotted lines.

Once the cylindrical work-piece 130 is in place on the modules 30 and 40, then the loading end hydraulic cylinder assembly 60 is once more connected for pivoting at 84 after first removing the C-shaped connectors 100, best seen in FIGS. 2 and 3, so that the upper module can be raised enough for the connection of the cylinder assembly 60 thereto at the loading end, such lifting being done also by the forklift truck and the lifting member 122 for easy operation.

Next, a lower or second module holder 170, best seen in FIG. 1, is swung up into place for engaging a flange of the lower I-beam 94.

The holder 170 is a hook having its lower end pivoted by suitable means at 174 to the frame 20 so that the hook 170 can have its upper portion closed above a lower flange of the I-beam 94 where it is held in place well by a ridge 175 fixed to the upper side of the lower flange 176 of the I-beam 94, and such as is received in a notch 178 on the underside of the upper portion of the holder 170.

When the holder 170 is not in the position shown in FIG. 1 for restraining upper movement of the loading end of the lower module 40, then it can be flipped downward out of the way.

When the holder 170 is in place for holding, then the I-beam 94 cannot move upwardly at the loading end and cannot move upwardly at its other end because of its pivot at 144 fixing it to the frame 20.

Referring now to FIG. 3, the position of the modules 30 and 40 right after the placing of a cylindrical duct work 130 on the machine is there shown. The duct-pressing major surface of the upper module 30 is the upper side of a upper or first module head 200 which rests on the I-beam 80 and can be easily removed for replacement by a larger or smaller head, whereby the machine is useable for different sizes of duct work.

This same is true in FIG. 3 at the lower module 40 where the second or lower duct-pressing major surface 44 is the lower side of the lower head 206 which is removably bolted to the lower I-beam 94 in any suitable manner, such as by bolts 204 welded at their lower ends to the lower head 206 and extending removably upwardly through the lower flange of the lower I-beam 94 and receiving nuts 212.

In FIG. 3 it will be seen that the C-shaped clips 100 hold their position well because of ridges 214 fixed to the upper sides of the lower flange 216 of the upper I-beam 80. The ridges 214 are outwardly from the web 218 of the I-beam 80 farther than downwardly extending hook end 222 of the upper part of each C-shaped clip 100.

Figure 4:
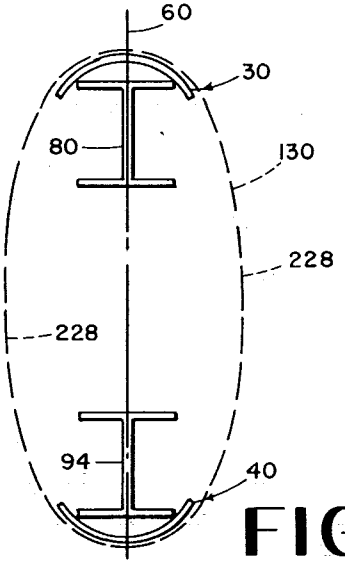
FIG. 4 is a view similar to FIG. 4, but at a later stage after the pressing modules have been pushed apart whereby the duct is shown in dotted lines in an oval shape. The clips have been removed before the modules are pushed apart, and in this view the modules are only shown diagrammatically and less completely than in FIG. 3.

In FIG. 4 it will be seen that it is an objective to push the modules 30 and 40 apart so as to stretch the duct 130 into a new shape by making it more oval, as shown in FIG. 4. But, the ultimate objective is to make the duct of such shape that its sides 228 become flat and parallel to the axis 60 so that the finished product is, therefore, what is known in the trade as "flat-oval".

Figure 5:
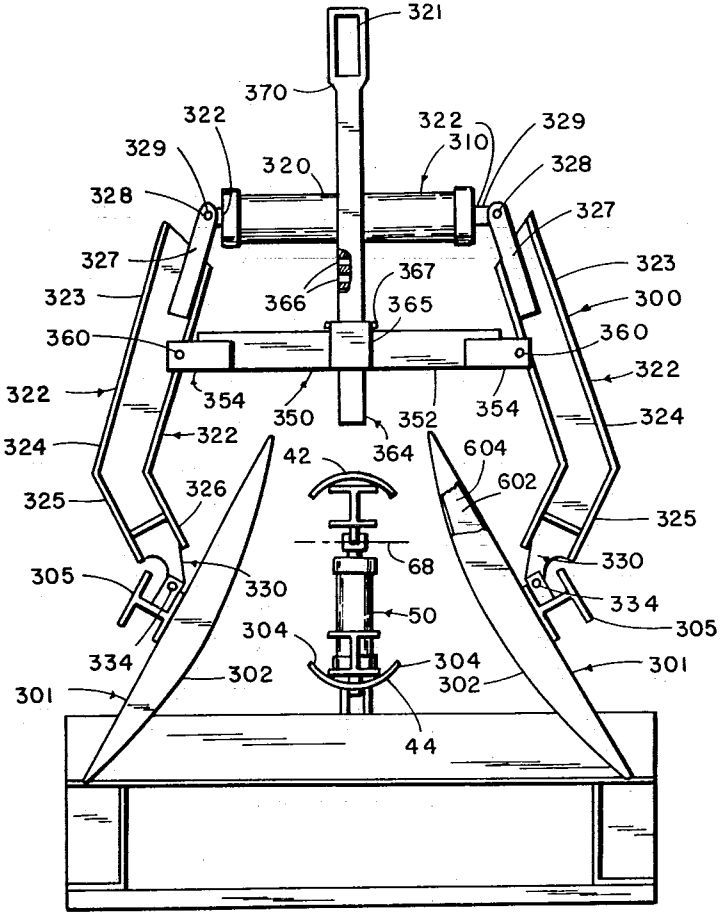
FIG. 5 is a view of the machine as taken lengthwise of its major-axis pressing modules without the closer hydraulic cylinder for pressing apart, the pressing modules being shown and without the showing of floor and wall building elements, and also without an upper support of FIG. 1. Certain parts are broken away in FIG. 5 to show interior construction. Minor axis compactors are shown in FIG. 5 in a relaxed position in which they would tend to hang by gravity prior to their engagement with a cylindrical duct work. Upon such engagement the arcuate compactors will tilt into more upright positions.

As best seen in FIG. 5, the machine further has a minor axis compacting assembly generally indicated at 300 and having first and second duct compacting minor surfaces extending along first and second sides 304 of the modules 30 and 40.

The surfaces 300 are on first and second compactors 301 and the compactors have their minor surfaces 304 shaped so as to be convex as seen in an end view looking along the machine from an end, as in FIG. 5, of the very elongated duct pressing major surfaces 42 and 44.

On the outer side of each of the compactors 301 is an I-beam 305 which forms a part of a minor axis forcing means generally indicated at 310 and having a hydraulic cylinder 320 which extends horizontally transversely to the length of the major surfaces 42 for forcing outwardly on the upper ends of downwardly extending arms 324 which are attached by hinge assemblies 330 to the I-beams 305 for rotation of the I-beams 305 with respect to the respective arms 324 about a horizontal axis 334 of pivoting extending lengthwise of the major surfaces 42. The axes of pivoting 334 are parallel.

At the upper ends of the arms 324 hinge assemblies 329 attach opposite ends of the hydraulic cylinder 320, and more specifically, the pistons 322 thereof, to the hinge assemblies 329, which latter are fixed by bars 327 to upper ends of the arms 324 for the rotation of the arms with respect to the piston rods 322 about horizontal axes of pivoting 328, which latter extend lengthwise of the major surfaces 42.

Each arm 324 forms a part of the carrier assembly 322 and each arm 324 has a lower portion 325 extending inwardly somewhat toward the lower major surface 44 at an acute angle with respect to the vertical, the portions 325, at the same time, extending downwardly.

Each arm 324 further has an upper portion 323 which is attached to its lower portion 325 that not only extends upwardly and inwardly therefrom to some extent, but also at an acute angle with respect to the vertical.

An arm-holding assembly is generally indicated at 350 and has a stiff member 352 extending horizontally across the top of the major surace 42 and is fixed by hinge assemblies 354 at each of its ends to the respective ones of the upper sections 323 of the arms 324 for pivoting about horizontal holding axes 360 on the left and right of the machine respectively, as seen in FIG. 5.

The arm-holding assembly 350 is supported by having a member 365 attached thereto and fixed to a suspension member 370 by means of a pin 367 which can extend through various ones of horizontally extending holes 366 through member 370 so that the arm-holding assembly 350 and all that is attached thereto, including the minor axis compactors 301, can be disposed higher or lower on the suspension member 370 to adjust for ducts of greater or lesser diameter.

The member 370, seen in FIG. 5, is provided with an opening 371 therethrough which receives slidably an upper support 372 which can be fixed to elements 380 which form parts of a building structure generally indicated at 382, which latter has a floor 384, whereby the building itself forms part of The frame 20 of the machine. It is on the floor 384 that the machine rests and to which it is secured by bolts 386, as best seen in FIG. 1.

In FIG. 1, it will be seen that horizontal members 390 interconnect the members 365 with the arm-holding assembly horizontal members 352, although the latter is best seen in FIG. 1, and on the left-hand side thereof.

In FIG. 5, the pivot axes 334 of the minor axis compactors 301 are purposely disposed above the center of gravity of the compactors 301 so that the lower ends thereof tend to hang relatively vertically below the axes 334 rather than further outward from the lower or second module 740 and this forms a means for maintaining the compactors in such positions that the compacting surfaces 302 face the modules whereby the pivotal mounting of the compactors at 334 and the convexity of the surfaces 402 tend to permit them to more easily move toward the center of a duct engaged by the modules 730 and 740.

Figure 6:
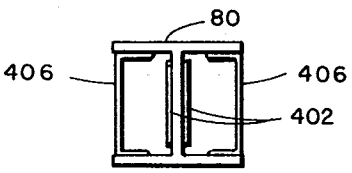
FIG. 6 is an end view of the preferred modified form of an I-beam and associated reinforcement of a pressing module of the invention as used for both upper and lower pressing modules.

Referring to FIG. 6, a sample of the reinforced I-beam structure is shown that is common to both the upper module 30 and the lower module 40.

In FIG. 6 the I-beam 80 has the outer ends of its flanges braced by having attached thereto and disposed therebetween two channel members 406 respectively and extending continuously along the entire I-beam 80.

The web of the I-beam 80 is reinforced on each side by welded-on brace-plates 402 which also extend the complete length of the I-beam 80.

In FIG. 5 the end view of the compactors 301 is shown revealing that each has a curved compacting covering 601 convex on its module side and concave on its other side.

The curvature of the coverings 601 is maintained by stiffening plates 602 which are flat and extend to and are welded to the compacting coverings 601 respectively all along the upper and lower edges of the compacting coverings 601.

Additional strength is provided by vertical planar parallel braces 604 spaced along the compactors 301 equidistantly and welded to the respective coverings 601 and 602 along adjoining surfaces.

Each brace 604 completely fills between the coverings 601 and 602 in the area in which a respective brace 604 lies.

In FIG. 7 portions of a modified duct-shaping machine of this invention are shown and the machine itself is generally indicated at 700, having a frame 720 having a member 752 extending upwardly so that its upper end has a pin 744 extending therethrough providing a pivot axis 745.

The pin 744 is part of a hinge assembly 750 and attaches member 752 to one of the modules 730 and 740, preferably to an extension 762 on the lower I-beam 780. The modules 730 and 740 are equivalents of the modules 30 and 40.

At the end of the extension 762 which is opposite to the duct-loading end of the modules is a pivotal connection 768 connecting the extension 762 with an automatic module swinging power assembly 770.

The power assembly 770 can be a hydraulic cylinder assembly 772, hinged at its lower end to a frame member 774 by a hinge 776 for pivoting about an axis 778, transverse at 90 degrees to the elongation of the module 730 and parallel to a pivot axis 782 at the hinge 768.

The hydraulic cylinder assembly 770 includes a hydraulic power operated supply assembly 784 which is operated by a push button 790.

When the button 790 is pushed the assembly 770 will pull downwardly on the extension 762, causing the lower module 740 to pivot about the axis 745 so as to swing up at its duct-loading end, which is to the right and not shown in FIG. 7, whereby the same thing is accomplished as is done by the use of the fork-lift truck 120 of FIG. 2. In the use of the assembly 770 the clips 100 of FIG. 2 are also temporarily employed although they are not shown in FIG. 7. The assembly 770 which is used only when the hydraulic cylinder assemblies 60 of FIG. 1 are disconnected since all parts which are not shown in the modification 700 of FIG. 7 are identical to those shown in FIG. 1.

In FIG. 7 the upper I-beam 800 is somewhat longer than the I-beam 80 of FIG. 1 so that it extends beyond the I-beam extension 762 of FIG. 7 to the left where it is attached by a hinge assembly 840 to a hydraulic cylinder assembly 842 which defines a major axis forcing assembly 842 which is a substitute for the hydraulic cylinder assembly 50 of the left-hand side of the modification of FIG. 1.

The hydraulic cylinder 842 is connected at its lower end by a hinge assembly 848 and by a bolt 850 to a selected one of a plurality of vertically spaced openings 852 in a cylinder carrier 854 fixed to the frame 20 just as are similar cylinder carriers at the ends of the machine of FIG. 1 for the cylinders 50 thereof.

It is to be understood that the automatic module-swinging power assembly 770 can be made in may other ways and need not necessarily be hydraulic.

Figure 8:
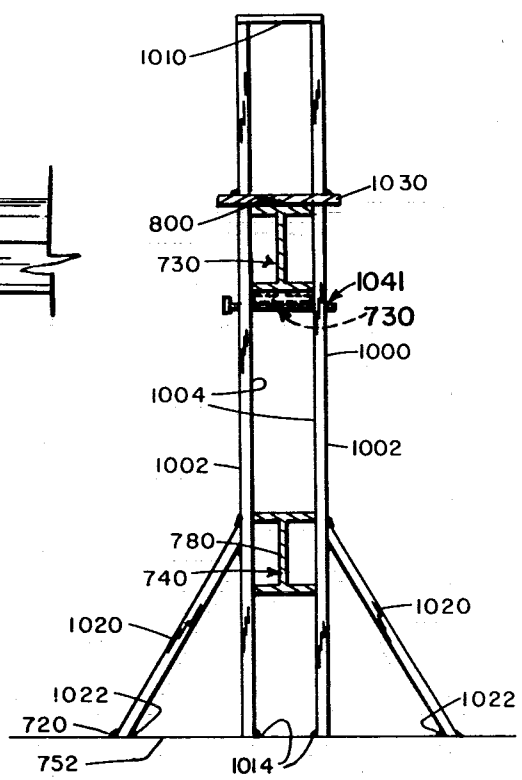
FIG. 8 is a sectional view taken along the line 8—8 of FIG. 7 but with many parts not shown.

Referring to FIG. 8, which is a sectional view taken along the line 8—8 of FIg. 7, we see there a steadying assembly generally indicated at 1000 and having two vertical posts 1002 disposed one on each side of the lower and upper I-beams 780 and 800.

The posts 1000 have inner guiding surfaces 1004 which face the beams 780 and 800 and snuggly and slideably receive the sides thereof, which is of importance to prevent the 780 and 800, in particular, from swaying from side to side laterally.

The posts 1002 are connected at their upper ends well above the beam 800 by a tie 1010. The lower ends of the posts 1002 are fixed, as seen in FIG. 7, by welds 1014 to any suitable part of the frame 720 of the machine, such as to a part 752 as seen in FIG. 7.

The posts 1002 are each braced by an inclined brace 1020, each brace extending from attachment to a central part of the respective post 1002 downward and outward to a place where each brace is anchored by a weld 1022 to the frame member 752.

The location of the posts 1002 is preferably between the pivot axis 745 and the pivot axis 782 so as to be clear of two duct-pressing convexially outer surfaced beam coverings 1080 and 1140 seen in FIG. 7.

The posts 1002 have the effect also of preventing longitudinal movement of the upper beam 800 because the elongated retainers 1030 are welded at 1032 to the top of the upper beam 800 and slideably receive therebetween the posts 1002 for snug but slideable fit. The retainers 1030 extend laterally outward from the sides of the beam 800 so as to slideably engage the posts 1002.

The posts 1002 have vertically spaced keeper openings 1040' which extend completely through the steadying assembly 1000 and through both posts 1002 for receiving a keeper, 1041, seen in FIGS. 7 and 8 and adapted to support the first or upper module 800 in cooperation with the posts 1002 which latter can be considered as parts of the frame 720 or as connected thereto.

Figure 11:
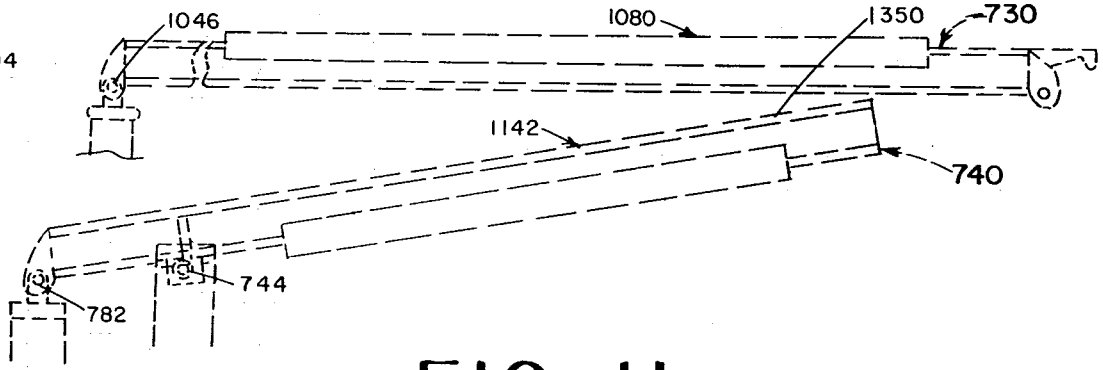
FIG. 11 is a diagrammatic view of a position of the lower module of the modification of FIG. 7 at a time when it is used to support the free loading-end of the upper module preparatory to the placing of a round tubular duct over the modules.

The keeper 1041 can be inserted through a desired one of the openings. 1040' for supporting the weight of the forward part of the I-beam 800 when the latter is unsupported at its forward end as in FIG. 11. The rearward end of the beam 800 is pivotally attached at the axis 1046 to the upper end 1050 of the hydraulic cylinder assembly 842, as best seen in FIG. 7. The keeper 1041 is used at a time when the hydraulic cylinder assembly or major axis forcing assembly 842 has its hinge-bolt 850 in a lower one of the openings 852 seen at the left end of FIG. 7 to hold the other or left end of the upper module 730 down so that its engagement with the keeper 1041 will cause the loading end or right end of the first or upper module 730 to be supported at times when it is not supported by the lower or second module 740.

In FIG. 11 the lower module 740 is shown supporting the loading end of the upper module 730 as is useful so that when the other or least end of the upper module 730 is raised by the major-axis forcing assembly 842, this makes possible insertion of the keeper 1041 under the raised upper module 730 as shown in FIGS. 7 and 8 at a time when the loading end of the upper module is being upheld by the lower module 740, as in FIG. 11. Following this, a lowering of the upper module 730 into the dotted line position of FIG. 8 will cause it to be supported by the keeper.

In FIG. 7, a post 1002 can be considered as attached to the frame in one sense, but also can be considered part of the frame in another sense. The posts 1002 are disposed in close adjacency to the upper I-beam 800 of the upper or first module 730, therefore, the first module 730 is retained from excessive movement laterally of itself and yet permitted to move upwardly and downwardly with respect to the posts 1002.

The elongated retainers 1030 are fixed to the first module 730, as described, and are slidably engageable with at least one of the posts 1002 so as to prevent the module 730 from moving lengthwise of itself excessively and with respect to the posts 1002.

In FIG. 8, a keeper 1041 in the form of an elongated bolt is adapted to extend through any pair of the vertically spaced openings 1040' in the posts 1002 so that the keeper 1041 can be put at any level, whereby the lower side of the upper module 730 can be rested on the keeper 1041 for causing the upper module to be supported and at times to pivot at the keeper 1041.

In FIG. 11, the lower module 740 can be used to support the right end or loading end of the upper module 730. When it is supported in this manner, the keeper 1041 of FIG. 8 can be inserted closely under the upper module 730 to support it at that point. This then makes possible the support of the upper module 730 without help from the hydraulic cylinder 842 at its left end.

Such support is then at the keeper 1041 and at the place where the right end of the lower module 740 engages the right end of the upper module 730 as in FIG. 11.

This makes possible the removal of the bolt at 850, in FIG. 7, and the vertical adjustment of the lower end of the cylinder 842. This is important because of the various sizes of the ductwork that is to be handled by the same machine.

After the cylinder 842 is adjusted to its new position then the support by the lower module in the manner of FIG. 11 can be used in conjunction with the cylinder 842 to position the keeper 1041 in a new one of the openings 1045. Thereafter, support from the lower module 740 is no longer needed as the upper module 730 is supported by the cylinder 842 and by the keeper 1041. This makes the upper module free and open to receive a duct thereon to be shaped after the duct has been passed across the right end which is the receiving end of the upper module 730 simultaneously as it is passed across the right or receiving end of the lower module 740.

Figure 10:
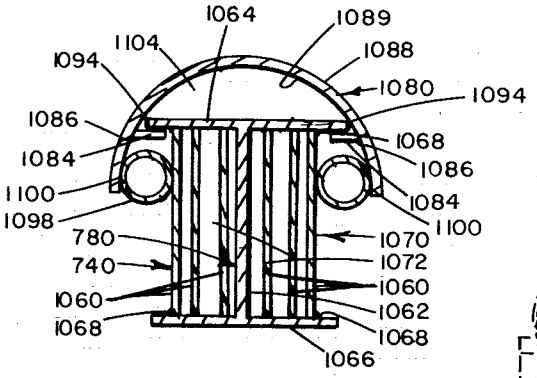
FIG. 10 is a sectional view taken along the line 10—10 of FIG. 7.

Referring now to FIG. 10, a typical preferred construction of a duct-shaping major-axis module is there shown and illustrated by the upper module 740 which has, as one of its parts, a lower I-beam 780. The I-beam 780 is further strengthened by auxilliary vertical webs 1060 disposed horizantally spaced from and one on each side of the central web 1062 of the I-beam 780.

The webs 1060 are welded to the inner sides of the upper and lower flanges 1064 and 1066 of the I-beam 780 as seen at welds 1068.

In this manner a composite beam is formed which is given a general number 1070 and which is part of a plurality of vertical webs spaced by openings 1072.

The upper flange 1064 extends beyond the auxilliary webs 1060 on each side of the composite beam 1070 and an arcuate cover 1080 extends from a point beneath one side of the upper flange 1064, across the top of the upper flange 1064, and down past the opposite side edge of the flange 1064.

Thus the elongated positioning bosses 1084 are welded one to each of the inner sides of the arcuate cover 1080 immediately beneath and closely adjacent to the upper flange 1064 of the composite beam 1070 on one side thereof, the other elongated positioner 1084 being in a similar position beneath the opposite end of the flange 1064. The elongated positioners 1084 are suitably welded to the inner side of the cover 1080 at 1086 respectively.

As seen in FIG. 10, the arcuate cover 1080 has a convex upper surface 1088 and a concave under surface 1089. The under surface 1089 of the cover engages the upper portions of the outer edged of the flange 1064 along horizontal lines 1094 extending the length of the cover 1080.

It is along the lines 1094 that the composite beam 1070 supports the cover 1080 as the cover itself presses against a round duct being shaped into an oval duct.

The arcuate cover 1080 extends beyond the elongated positioners 1084 on each side thereof a substantial distance for receiving side engagers 1098 disposed between the outer sides of the auxilliary webs 1060 of the composite beam 1070 and the inner side 1089 of the cover 1080 to which latter each engager 1098 is welded at 1100.

The side engagers 1098 are elongated pipes of cylindrical exterior and can extend the entire length of the cover 1080.

As thus described the cover 1080 can be easily moved lengthwise to remove it from the composite beam 1070. Likewise another cover 1080 can be put in place when a different sized cover, smaller or larger, is desired to work with a duct of a different size, smaller or larger.

During this removal or insertion the side engagers 1098 will slide freely along the outer webs 1060 which they slideably engage or else are in close adjacancy thereto. Since the under side of the cover 1080 has a slot there through at 1104, the cover 1080 is freely slideably received on the upper flange 1064.

The elongated positioners 1084, are in close adjacancy to the under sides of the upper flange 1064 at times when the upper flange is in engagement with the under side surface 1089 of the cover 1080.

As best seen in FIG. 7, the lower module 740 if seen in a vertical cross-section would look like the inverse of FIG. 10 and the lower module 740 as an arcuate cover 1140 covering the under side of its composite beam 1142.

Referring to FIG. 10, the auxiliary webs 1060 on each side of the I-beam web 780 can be of any number, as can vary, depending upon the thickness of the webs, to obtain the same strength. In FIG. 10, three auxiliary webs 1060 are shown on each side of the I-beam web 780.

In FIG. 10, a lower module 740 is shown in cross-section, but its construction is identical, except for being inverted, with the construction of the upper module 730.

As seen in FIG. 10, the composite beam 1070 is economically formed first from a common "I-beam" for economy. Such beams are economically made by extrusion. The portions of the composite beam 1142 which are made from the common I-beam are the I-beam web 780 and the upper and lower flanges 1064 and 1066.

Since the upper and lower flanges 1064 and 1066 each extend on each side of the central web 780, therefore, the portions thereof which extend on each side of the web 780 form projecting flange portions that project horizontally beyond the remainder of the composite beam 170 and, specifically, beyond the outermost auxiliary web 1060 of the composite beam 1070, for providing surfaces facing away from the opposite module which can be engaged by positioners 1084 fixed to the inner sides of the cover 1080 for holding cover in position with respect to the composite beam 1070, there being one positioner 1076 on each side of the beam 1070 and slidable with respect to the beam 1070 and closely arranged with that side of the respective flange 1064 which faces away from its cover 1080.

In addition to the positioners 1084, there are also the side engagers 1098 disposed in the cavity 1104 on the outer side of the positioners 1084 from the center of the cover 1080.

The side engagers 1098 are fixed to the cover 1080 on a center side and extend the length of the cover 1080 and are slidable with respect to the composite beam 1070 and are adapted to closely fit the respective opposite sides of the composite beam 1070 to further steady the cover 1080 on the composite beam.

It is important that the cover 1080 be open at one end so that it can be slid onto the composite beam.

The composite beam 1070 has at least three webs extending substantially in planes normal to the elongation of the beam, as seen in FIG. 10, and parallel with the direction of movement of the major surfaces of the modules. The beam further has two flanges disposed at the ends of the webs and interconnecting the ends of the webs in a range normal to the webs.

The side engagers 1086 are capable of preventing the cover 1080 from falling off of a composite beam 1070, as is particularly important as regards the upper module 740.

The cover 1080 does not extend the entire length of the composite beam 1070 on either one of the modules so as to make possible room for the pivot connection at 744 in FIG. 7 and to make room for the posts 1000 of FIG. 7 which are to engage the composite beam of the upper module without interference from the cover 1080 thereon, which later is best seen in FIG. 10.

In FIG. 7, the openings 1040' can receive a keeper not shown, for supporting the upper module 730 from the posts 1002 so that with the bolt 850 removed and the cylinder 842 loosened, the left end of the beam in FIG. 7 can be raised by pulling down on the module 730 at its right end by means of the hydraulic cylinder assembly 50. In this way an additional member similar to member 840 can be used as an extension of the member 854, extending upwardly therefrom, whereby the bolt 850 can be inserted at a higher place.

Next, the cylinder 750 can be elongated and a keeper, not shown, can be put in a higher one of the openings 1040'.

Repetition of this process can be used as a means to raise the upper module 740 and the cylinder assembly 842 into a new position for handling a larger duct.

Figure 9:
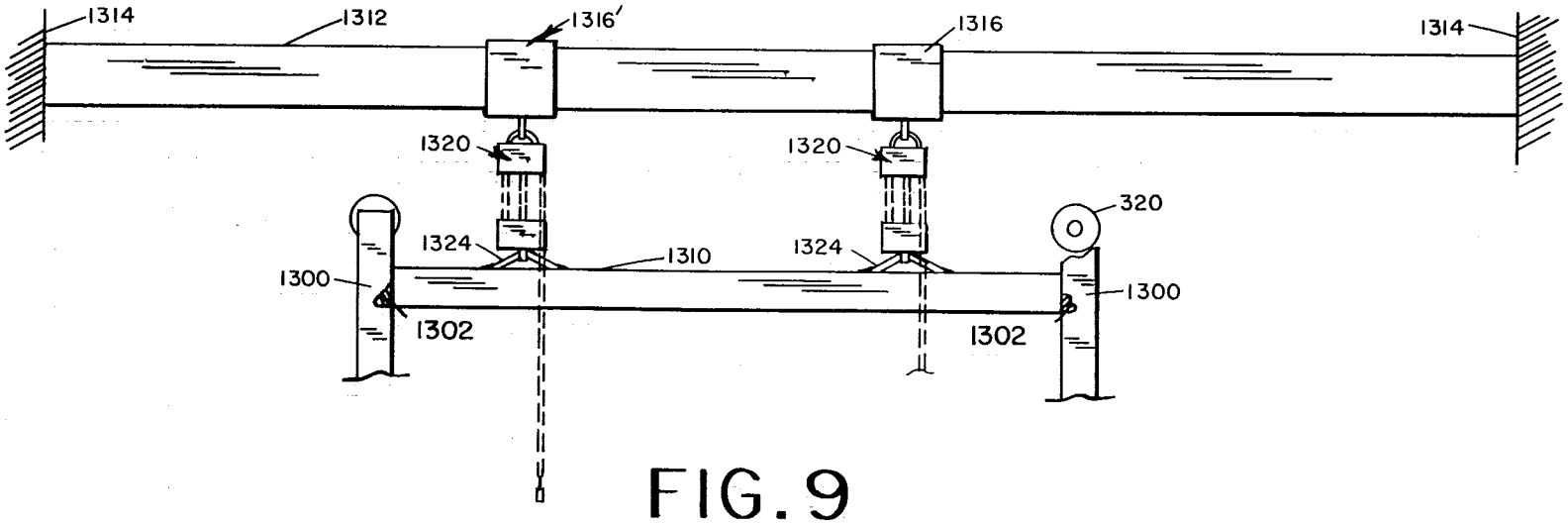
FIG. 9 is a view of the modification of FIG. 7 and shows the upper part of the machine, substituting for the upper part of FIG. 1.

Referring now to FIG. 9, a modified system for raising and lowering the two horizontal members 352 is generally indicated at 1316' and shall also be called a pulley hoist means 1316'. The pulley hoist means 1316' is capable of quick and minute adjustments in the positioning of the compaction assembly with respect to the modules.

This is a substantial improvement over the system of FIG. 1 which requires a lifting by a forklift truck in order to make possible positioning. Also, the positioning with the FIG. 1 system can only be done at the spaced openings 366' and members 364 which is not capable of quick and minute adjustments as is the system defined by the pulley-hoist system 1316' of FIG. 9. However, stiff members 352 of FIG. 5 are given the numeral 1302 in FIG. 9 even though the construction is the same because in the modification of FIG. 9 they are connected directly to an elongated horizontal support 1310 which latter extends completely from one of the horizontal stiff members 1302 to the other and is rigidly connected thereto so that when the support 1310 is raised the result will be that the first and second compacters 301 will be raised for adjusting their position upward quickly and easily and precisely because the support 1310 is raised by hoists 1320 which can be chain hoists as shown of a manual nature or can be power operated wenches.

The hoists 1320 are connected by brackets 1324 to the support 1310 at two spaced apart points and the upper ends of the hoists 1320 are connected to attachers 1316 which are attached to the horizontally elongated upper support 1312 which suitably fixed to parts of a building structure indicated at 1314.

In operation the hoist system is superior to the system of FIG. 1 with its openings at 366 prime because the openings 366 prime give only places for adjustment between which adjustment cannot be achieved.

Another advantage of the system at FIG. 9 is that it is of less interference with the placing on of very large ducts than the system of FIG. 1 in the respect that the member 364 at the loading end of the machine of FIG. 1 interfered with the placing on of larger ducts.

In FIG. 11, the lower module 740 is shown with its forward end supporting the loading end of the upper module 730 at a time when the hydraulic cylinder normally supporting it is removed from it.

I claim:

1. A duct-shaping machine comprising a frame, first and second major-axis duct-shaping modules each having a duct pressing major surface, said modules being elongated and having ends and first and second opposite sides, said major surfaces being spaced apart and facing in opposite directions, a major-axis forcing means on said frame and connected to said modules for forcing said modules to move apart so as to cause said major surfaces to move apart with respect to each other substantially linearly in a first direction, a minor-axis compaction assembly comprising spaced first and second comactors having minor-axis compacting surfaces facing said modules and extending along said first and second sides of said modules, minor-axis forcing means for forcing said minor-axis compacting surfaces toward said modules, said minor-axis forcing means comprising an arm-holding assembly attached to said frame, a pair of elongated arms extending normally to the elongation of said modules, means pivotally attaching said arms to said holding assembly for the swinging of said arms about respective arm axes which are disposed on opposite sides of a plane extending through the centers of said pressing surfaces and extending along said pressing surfaces, said arm axes being disposed substantially with their elongation parallel to the elongation of said pressing surfaces, pressure-applying means pivotally connected to the upper ends of said arms for the hinging of the upper ends of said arms on said pressure-applying means about pressure axes each of which are parallel to said arm axes and disposed on the opposite side of said modules from said arm axes, means attaching the lower ends of said arms to those sides of said compactors which are opposite said modules.

2. The duct-shaping machine of claim 1 having said pressing means being a hydraulic cylinder assembly having piston rods at each end and extending in opposite directions, means attaching each of said piston rods to respective ones of said arms.

3. The duct-shaping machine of claim 1 having said means mounting said compactors on the lower ends of said arms accomplishing a hinging mounting of each respective compactor about a compactor axis, said compactor axes being parallel to said arm axes and disposed on opposite sides of said modules and in substantial parallelism with said pressing surfaces.

4. The duct-shaping machine of claim 3 having said compactors each having a compacting surface, said compacting surfaces facing each other, said minor-axis forcing means further comprising two minor axis pressing parts disposed one on each of said opposite sides of said compactors, said minor-axis forcing means comprising first and second compactor-carriers disposed on opposite sides of said compactors respectively from said compacting surfaces thereof, means attaching said compactor-carriers to said means attaching said minor axis pressing parts.

5. The duct-shaping machine of claim 4 having said compactors each having a compacting covering facing said modules and each having one of said compacting surfaces thereon, said compacting surfaces each being of convex shape as seen from an end thereof, said compactors each being hollow.

6. The duct-shaping machine of claim 5 having said means attaching said compactor carriers to said minor axis pressing parts accomplishing pivotal connection on respective axes extending normal to said minor axis.

7. A duct-shaping machine comprising a frame, first and second major-axis duct-shaping modules each having an elongated duct pressing major surface, said pressing surfaces being elongated and parallel and having ends and first and second opposite sides, said major surfaces being spaced apart and facing in opposite directions, a major-axis forcing means on said frame and connected to said modules for forcing said modules to move apart so as to cause said major surfaces to move apart with respect to each other substantially linearly in a first direction, a minor-axis compaction assembly comprising spaced first and second compactors having minor-axis compacting surfaces facing said modules and extending along said first and second sides of said modules, minor-axis forcing means for forcing said minor-axis compacting surfaces toward said modules, means supporting said minor-axis compaction assembly on said frame, said modules having loading ends disposed one above the other onto which ducts are to be placed, the other ends of said modules also being one above the other, said second module having a pivotal connection to said frame at a place between its ends and much closer to said other end thereof for the pivoting of said second module about a second-module-axis transverse to the elongation of said second module, said loading end of said first module extending farther from said second module axis than the loading end of said second module whereby when said other end of said second module is moved downwardly said loading end of said second module will move upwardly toward the loading end of said first module and can be used to support the loading end of said first module when it is otherwise unsupported so as to be freely projecting beyond other parts of said machine for receiving a duct thereon.

8. The duct-shaping machine of claim 7 having said first and second modules being above and below each other all along their lengths to define a first and upper and a second and lower module, said major axis forcing means being attached to said frame and having a forcing assembly connected to said other end of said upper and first module and capable of raising said other end of said first module and also capable of holding said other end of said first module from moving upwardly, keeper means operatively correlated with said frame for supporting said first and upper module and preventing said first and upper module from moving downwardly at a point substantially spaced from the connection of said forcing assembly and said first and upper module and also spaced a greater distance from the loading end of said upper module than from said latter connection.

9. The duct-shaping machine of claim 7 having a pair of posts attached to said frame and disposed one one each side of said first module and disposed in a position for retaining said first module from excessive movement laterally of itself and for permitting said first module to move upwardly and downwardly between said posts.

10. A duct-shaping machine comprising a frame, first and second major-axis duct-shaping modules each having an elongated duct pressing major surface, said pressing surfaces being elongated and parallel and having ends and first and second opposite sides, said major surfaces being spaced apart and facing in opposite directions, a major-axis forcing means on said frame and connected to said modules for forcing said modules to move apart so as to cause said major surfaces to move apart with respect to each other substantially linearly in a first direction, a minor-axis compaction assembly comprising spaced first and second compactors having minor-axis compacting surfaces facing said modules and extending along said first and second sides of said modules, minor-axis forcing means for forcing said minor-axis compacting surfaces toward said modules, means supporting said minor-axis compaction assembly on said frame, said compacting surfaces each being convex at points all along their lengths as seen in cross-sections taken at a right angle to said pressing surface elongations, said minor-axis forcing means comprising a compactor carrying assembly attached to said frame, and having two compactor-attached support means disposed on and attached to those outer sides of said compactors which are on the opposite sides thereof from said modules, and pressure-applying means connected to said support means respectively and capable of pressing said compactors towards each other, said connections between each of said support means and its adjacent compactor being such as to permit pivoting of said compactors each about a horizontal compactor axis parallel to the elongation of said pressing surfaces, each of said convex compacting surfaces extending a substantial distance in opposite directions on each side of the respective compactor-axis, means for maintaining said compactors in such positions that their compacting surfaces face said modules whereby the pivotal mounting of said compactors on said axes and the convexity thereof tends to permit them to more easily move towards the center of a duct engaged by said modules.

11. The duct-shaping machine of claim 10 in which said means for maintaining said compactors in such positions that their compacting surfaces face said modules is the positioning of said compactor axes substantially spaced above the center of gravity of said compactors.

12. A duct-shaping machine comprising a frame, first and second major-axis duct-shaping modules each having an elongated duct pressing major surface, said pressing surfaces being elongated and parallel and having ends and first and second opposite sides, said major surfaces being spaced apart and facing in opposite directions, a major-axis forcing means on said frame and connected to said modules for forcing said modules to move apart so as to cause said major surfaces to move apart with respect to each other substantially linearly in a first direction, a minor-axis compaction assembly comprising spaced first and second compactors having minor-axis compacting surfaces facing said modules and extending along said first and second sides of said modules, minor-axis forcing means for forcing said minor-axis compacting surfaces toward said modules, means supporting said minor-axis compaction assembly on said frame, said means supporting said minor axis compaction assembly on said frame comprising a pulley hoist means giving capability of quick and minute adjustments in the positioning of said compaction assembly with respect to said modules.

13. A duct-shaping machine comprising a frame, first and second major-axis duct-shaping modules each having an elongated duct pressing major surface, said pressing surfaces being elongated and parallel and having ends and first and second opposite sides, said major surfaces being spaced apart and facing in opposite directions, a major-axis forcing means on said frame and connected to said modules for forcing said modules to move apart so as to cause said major surfaces to move apart with respect to each other substantially linearly in a first direction, a minor-axis compaction assembly comprising spaced first and second compactors having minor-axis compacting surfaces facing said modules and extending along said first and second sides of said modules, minor-axis forcing means for forcing said minor-axis compacting surfaces toward said modules, means supporting said minor-axis compaction assembly on said frame, at least one of said modules comprising an elongated beam, said beam having an elongated cover, said beam and said cover both being elongated in the direction of the respective elongated pressing major surface, said cover as seen in a cross-section taken in a plane normal to said beam being convex on a side thereof facing away from said beam, said cover having a cavity on its underside and opening at one end of said cover for receiving said beam as said cover is placed on said beam by sliding it lengthwise onto said beam, and means for preventing said cover from falling off of said beam transversely of said beam.

14. The duct-shaping machine of claim 13 having said beam as seen in a cross-section normal to the length of said beam having at least three webs extending substantially in spaced planes normal to the elongation of said beam and parallel with the direction of movement of said major surfaces, said beam further having two flanges disposed at ends of said webs and normal to said webs.

15. The duct-shaping machine of claim 14 in which said vertical webs are at least seven.

16. The duct-shaping machine of claim 14 in which said vertical webs are at least five.

17. The duct-shaping machine of claim 16 having first module retainer means fixed to said first module and slidably engageable with at least one of said posts so as to prevent said module from moving lengthwise of itself excessively with respect to said posts.

18. The duct-shaping machine of claim 16 having a keeper engageable with said first module in a manner such that said first module pivots about said keeper whereby said pivotal connection between said second module and said frame is at said keeper, means spaced along said posts for supporting said keeper at various selected distances from said second module whereby said keeper can be removed from a position of pivotal interconnection with said first module and can be placed again in any other one of said positions along said posts.

19. The duct-shaping machine of claim 13 having said means preventing said cover from falling off of said beam comprising said beam having oppositely projecting flanges projecting transversely of the elongation of the respective pressing major surface, said flanges having sides which face away from said cover, and positioners projecting from said cover and lapping said flanges on those sides of said flanges which are disposed facing away from said cover.

20. The duct-shaping machine of claim 13 having said cover having portions lapping sides of said beam and spaced from said beam, said cover and said beam defining a cover and beam assembly of which said cover and said beam are each major portions, a pair of retainers substantially filling the respective spaces between said cover and the sides of said beam to help stabilize the positioning of said cover on said beam, said retainers each being attached to said cover so said cover can be moved lengthwise of said beam for quick and easy removal and replacement by a similar cover of different size.

21. The duct shaping machine of claim 13 having said beam provided with flanges extending outwardly therefrom transversely of the length of the beam and a pair of positioners attached to said cover and extending inwardly from said cover toward said beam and lapping said flanges on those sides of said flanges which are disposed farthest from the respective opposite module so as to define said means for preventing said cover from falling off of said beam transversely of said beam, said positioners being slidable longitudinally of said beam together with said cover.

22. The duct shaping machine of claim 13 in which said at least one module having its elongated beam provided with substantially parallel sides extending along the length of said beam, and a pair of side engagers disposed on opposite sides of said beam and fixed to said cover and slidable with respect to said beam and closely adjacent said beam for steadying the position of said cover on said beam, said side engagers being received in said cavity of said cover.

* * * * *